US006527144B2

(12) United States Patent
Ritsche et al.

(10) Patent No.: US 6,527,144 B2
(45) Date of Patent: Mar. 4, 2003

(54) DISCHARGE APPARATUS FOR MEDIA

(75) Inventors: Stefan Ritsche, Eigeltingen (DE); Andreas Graf, Gottmadingen (DE); Juergen Greiner-Perth, Gottmadingen (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 0 days.

(21) Appl. No.: 09/899,309

(22) Filed: Jul. 5, 2001

(65) Prior Publication Data

US 2002/0008122 A1 Jan. 24, 2002

(30) Foreign Application Priority Data

Jul. 6, 2000 (DE) ..... 100 32 976

(51) Int. Cl.[7] ..... B05B 11/00

(52) U.S. Cl. ..... 222/162; 222/153.13; 222/321.7; 222/321.9; 222/383.1; 222/383.3; 222/385; 222/182

(58) Field of Search ..... 222/153.13, 162, 222/182, 321.7–321.9, 383.1, 383.3, 385

(56) References Cited

U.S. PATENT DOCUMENTS

| | | | | |
|---|---|---|---|---|
| 3,405,843 A | * | 10/1968 | Watson, Jr. | 222/162 |
| 3,726,442 A | | 4/1973 | Davidson et al. | 222/207 |
| 3,995,776 A | | 12/1976 | Micallef | 222/207 |
| 4,185,776 A | | 1/1980 | Nozawa | 239/333 |
| 5,377,869 A | * | 1/1995 | Weiss et al. | 222/192 |
| 5,839,621 A | | 11/1998 | Tada | 222/383.1 |

FOREIGN PATENT DOCUMENTS

| | | |
|---|---|---|
| DE | 44 11 031 | 3/1994 |
| DE | 196 10 456 | 3/1996 |
| GB | 659132 | 2/1950 |
| JP | 100 436 48 | 2/1998 |
| WO | WO 97/12686 | 4/1997 |

* cited by examiner

*Primary Examiner*—J. Casimer Jacyna
(74) *Attorney, Agent, or Firm*—Quarles & Brady LLP

(57) ABSTRACT

The invention relates to a discharge apparatus for media. Corresponding media discharge apparatuses are e.g. generally known in the form of pump atomizers.

Figure 1B:
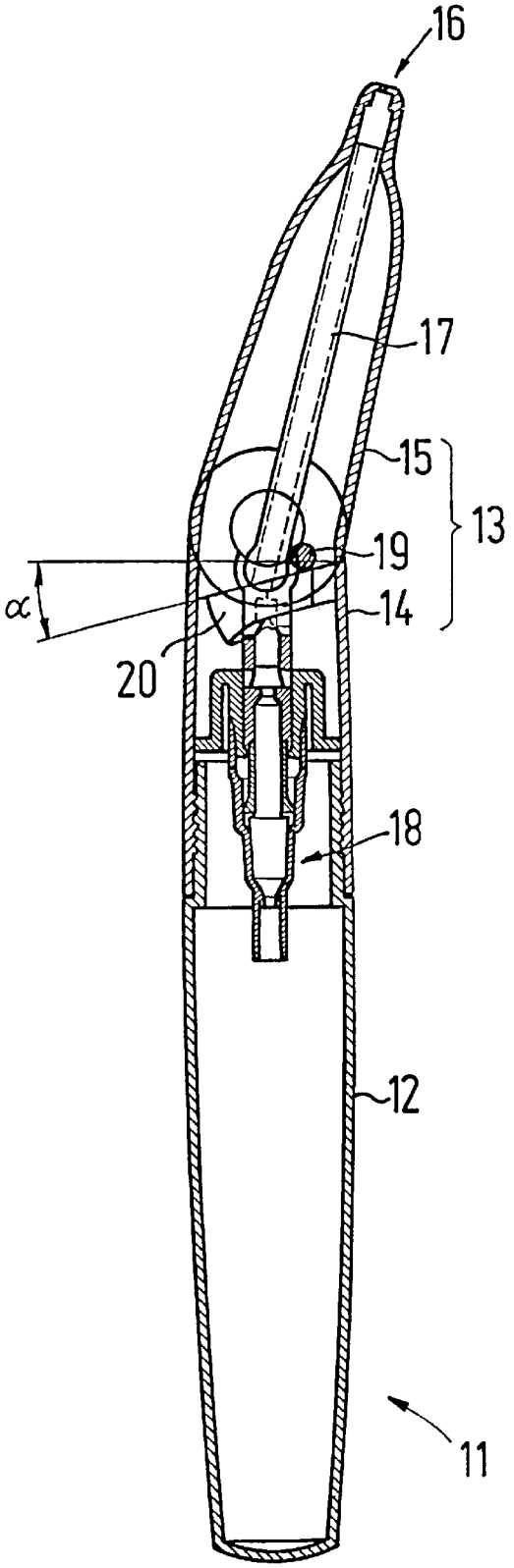

The problem of the invention is to create a greater freedom of design for the actuation of such discharge apparatuses.

This problem is solved in that the actuation direction of the actuating element of the discharge apparatus differs from the stroke direction of the pump element of the discharge apparatus.

6 Claims, 9 Drawing Sheets

DISCHARGE APPARATUS FOR MEDIA

The invention relates to a discharge apparatus for media. Discharge apparatuses for media are known in many different forms. It is common to all the discharge apparatuses that through the actuation of an actuating element a medium is discharged. To this end it is known to stock or store the medium in a medium or media container from which the medium is discharged by means of a pump element. The pump element and usually also the media container are placed in a casing.

Such discharge apparatuses for media are e.g. generally known in the form of pump atomizers for small perfume bottles.

However, the use of such discharge apparatuses is not limited to the cosmetics field. In fact other liquid media, particularly at least one pharmaceutical substance-containing media can be stored in such a media container and discharged by means of such a discharge apparatus.

It is disadvantageous in such media means that as a result of the use of a pump element it is necessary to have a coaxial arrangement of pump element and media container. The arrangement of the pump element and its main extension axis also predetermine the actuating direction of the actuating element, which is located in the axis of the pump element or in the main axis of the container.

However, an actuation of the actuating element oriented in this way is not always the ergonomically most favourable actuating element arrangement.

Thus, the problem of the invention is to provide a greater freedom of design for the actuation of such discharge apparatuses.

On the basis of a discharge apparatus according to the preamble, this problem is solved by a discharge apparatus having the features of the characterizing part of claim 1.

Media discharge apparatuses according to the invention have a casing, which has a discharge opening for the discharge and in particular spraying of a preferably liquid medium. The media are e.g. cosmetics, particularly perfume, but can also be liquids containing pharmaceutical agents. Fundamentally such a discharge apparatus can be used for any type of medium, which can be discharged from a container by a pump. Particular suitability occurs with liquids, but the contents can equally well have a gel or-foam-like nature. In certain circumstances solid can also be contained in the liquid. Such a discharge apparatus is also suitable if there is a mixing of two fluids or one fluid and a solid during a discharge stroke. The media container storing the dischargeable medium is located in the casing. For delivering medium from the media container to the discharge opening a pump element is provided. On producing a pump element discharge stroke medium is discharged from the media reservoir via the casing discharge opening to the discharge location. The actuation direction of the actuating element is directed away from the stroke direction of the pump element and the angle between the two directions is preferably approximately 90°.

According to a preferred development of the invention for this purpose the actuating element is held in pivotable manner in the casing in a moving joint about a pivot pin.

According to a further development according to the invention the actuating element is constructed as part of the casing. This casing part is pivotably located on a main body of the casing. By a pivoting movement of the casing part with respect to the main body of the casing, a pump element discharge stroke is produced. The pivoting angle about which the casing part must be pivoted in order to produce a complete discharge stroke is preferably between 5 and 35°, particularly 15°. According to an advantageous development the pivot pin is constructed at right angles to the main extension axis of the main body. The main axis includes the stroke direction of the pump element. In particularly preferred manner the casing part contains the discharge opening and the media container and pump element are located in the main casing body.

According to another preferred development of the invention the actuating element is constructed as a pivoted or rocking lever. During a pivoting movement of the pivoting element an operating element constructed on the pivoted lever comes into at least indirect engagement with the pump element in such a way that on actuating the actuating element a pump element discharge stroke is produced. According to a further development the operating element is a gripper arm, which projects on the casing inside away from the actuating element and can engage behind a media container-side bead. During an actuation of the actuating element the gripper arm engages on the bead and starts to engage behind the same. As a result, during actuation, there is an action on the media container in such a way that a pump element discharge stroke is produced. The bead is in particular a fixing means mounted on a glass container neck. By means of said fixing means preferably a piston pump as the pump element is fixed to the media container. Simultaneously the pump element closes the media container opening, as is also the case in numerous other developments according to the invention.

According to another development the operating element is a guide link, in which is guided a slider, which is at least indirectly connected with the pump element, preferably with the piston of a piston pump. According to an advantageous development the slider is shaped on the rising tube leading from the pump element to the discharge opening.

Instead of a slider, as an alternative or additional possibility, the actuating element is acting on a pivoted lever located inside the casing. By the pivoting lever, the length of the lever arms thereof realising a force transmission, a movement is transferred into an actuation of the pump element. The orientation and lever arm length determine both force transmission and change of direction of the force direction of the actuation force into a discharge stroke. An example of such a pivoting lever is a rocker, that is a central bearing pivoting element adapted to generate a 90° diversion of force.

According to another preferred development of the invention an operating element is provided on both sides and symmetrically to the pump element. As a result of the bilateral engagement of the operating element on the pump element there is a more uniform force introduction onto the pump element and a tilting or jamming of the pump element during the actuation thereof is prevented.

According to another preferred development of the invention the actuating element is guided in the casing in such a way that it is held in relatively movable manner to the discharge opening, the media container being positionally defined on holding means, is held on the actuating element and placed in the casing and by means of the relative movement of the container with respect to the discharge opening a pump element discharge stroke is produced. According to a further development a rising tube is provided leading from the media container to the discharge opening. The rising tube is constructed in shape-stable manner and by means of the riser tube it is possible to actuate the pump element located on the media container. According to another preferred development of the invention for the fluid-tight fixing of the pump container, the media container has a fixing means, preferably a crimp sleeve. This fixing means has a fixing point, preferably a back-engageable bead or crimp ring, where the container is held on the actuating element.

According to another preferred development of the invention the actuating element acts by means of a reversing means differing therefrom on the medium container. The media container is arranged in relatively movable manner with respect to the discharge opening in the casing and a pump element discharge stroke is produced by the movement of the media container relative to the discharge opening. According to a further development thereof between the discharge opening and the pump element is located a shape-stable rising tube by means of which the pump element discharge stroke can be produced. According to a further development of the invention the reversing means are also constituted by a pivotably arranged lever. It is advantageous if between the actuating element and the lever it is possible to produce an engagement along a variable radius curve. As a result of the shape of the curve and the in each case different radius between the outer edge of the actuating element or lever and the pivot pin, it is possible to predetermine a transmission ratio between the actuating element and the lever which is of an appropriate nature and variable over the actuating path. Advantageously the actuating element can be pivoted into a rest position, where there is no engagement between the actuating element and the reversing means. In this actuating element position the discharge apparatus is secured against unintentional operation.

According to another preferred development of the invention at least one actuating element is provided which, by means of a toothed gear, acts on the pump element. It is advantageous to have two symmetrically arranged actuating elements which are coupled together at least indirectly and in particular via the toothed gear. This arrangement leads to a simultaneous and identically acting actuation of the two actuating elements.

According to another preferred development of the invention the actuating element is rectilinearly guided in a linear guide. According to a further development thereof the actuating element has a contact edge by means of which the actuating element acts on the pump element for producing a discharge stroke. The contact or engagement edge is constructed in such a way that it slides along a corresponding contact point of the pump element. The contact edge is so chamfered with respect to the linear guide that a force component is produced outside the extension direction of the linear guide. The chamfer predetermines a power ratio between the pump element and the actuating element.

According to a further development of the invention a guide link is formed on the actuating element. A slider, which is at least indirectly connected to the pump element, is guided in the guide link. The path curve of the guide link is selected in such a way that a force component acting on the slider is produced, which is not located in the extension direction of the guide link, but instead runs in the actuation direction or the pump element stroke direction. Here again the angle between the path curve and the linear guide is predetermined.

According to a further development of the invention the casing has a guideway, in which is also guided the slider, which is guided in the guide link. The casing-side guideway has the function of intercepting transverse forces, which cannot act towards the production of a pump element discharge stroke.

According to another advantageous development the actuating element has an elastically deformable moulding connected to the casing and preferably hermetically sealing the opening for the actuating element in the casing. Such an elastic moulding component may by itself have the function of the actuating element and also form a flat and/or tight sealing joint between casing and actuating element, this engagement being optional for most of the action mechanisms of the actuating elements for media discharge described herein.

According to an advantageous development of the invention the pump element is an axially operable pump.

In general terms when using the discharge apparatuses according to the invention it can be advantageous for there to be not only a force reversal, but also a force transmission. This can reduce any necessary high actuating forces, such as can e.g. occur if during the discharge a media mixing takes place (fluid-fluid or fluid-solid), at the cost of a correspondingly increased actuating path and as a result a more user-friendly construction is obtained.

Figure 1A:
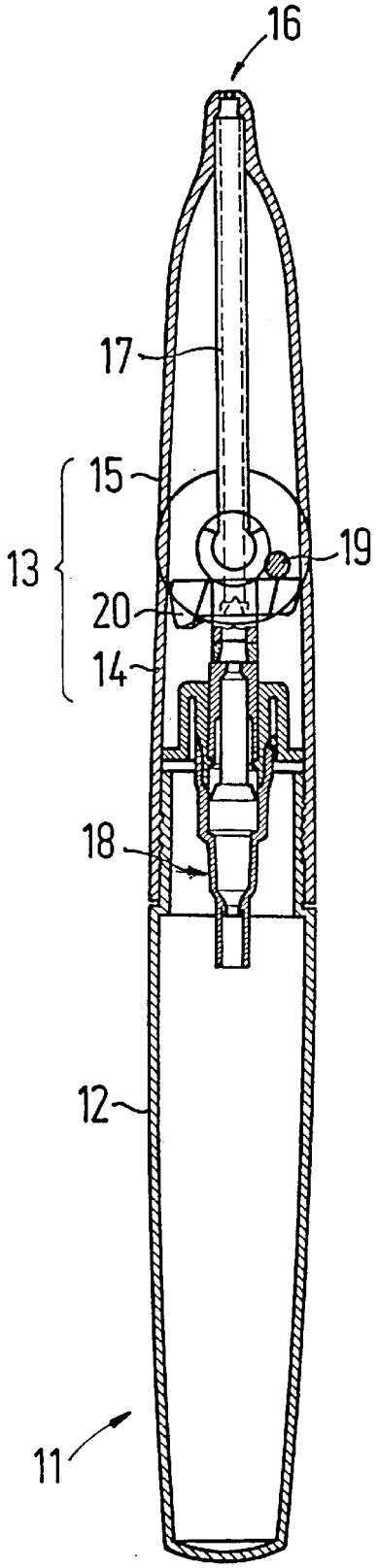

These and further features can be gathered from the claims, description and drawings and the individual features, both singly and in the form of subcombinations, can be implemented in an embodiment of the invention and in other fields and can represent advantageous, independently protectable constructions for which protection is hereby claimed. The invention is illustrated by the attached drawings, wherein show:

FIGS. 1*a* & 1*b* A diagrammatic sectional representation through a discharge apparatus, where the casing is subdivided into a main body and a part.

Figure 2:
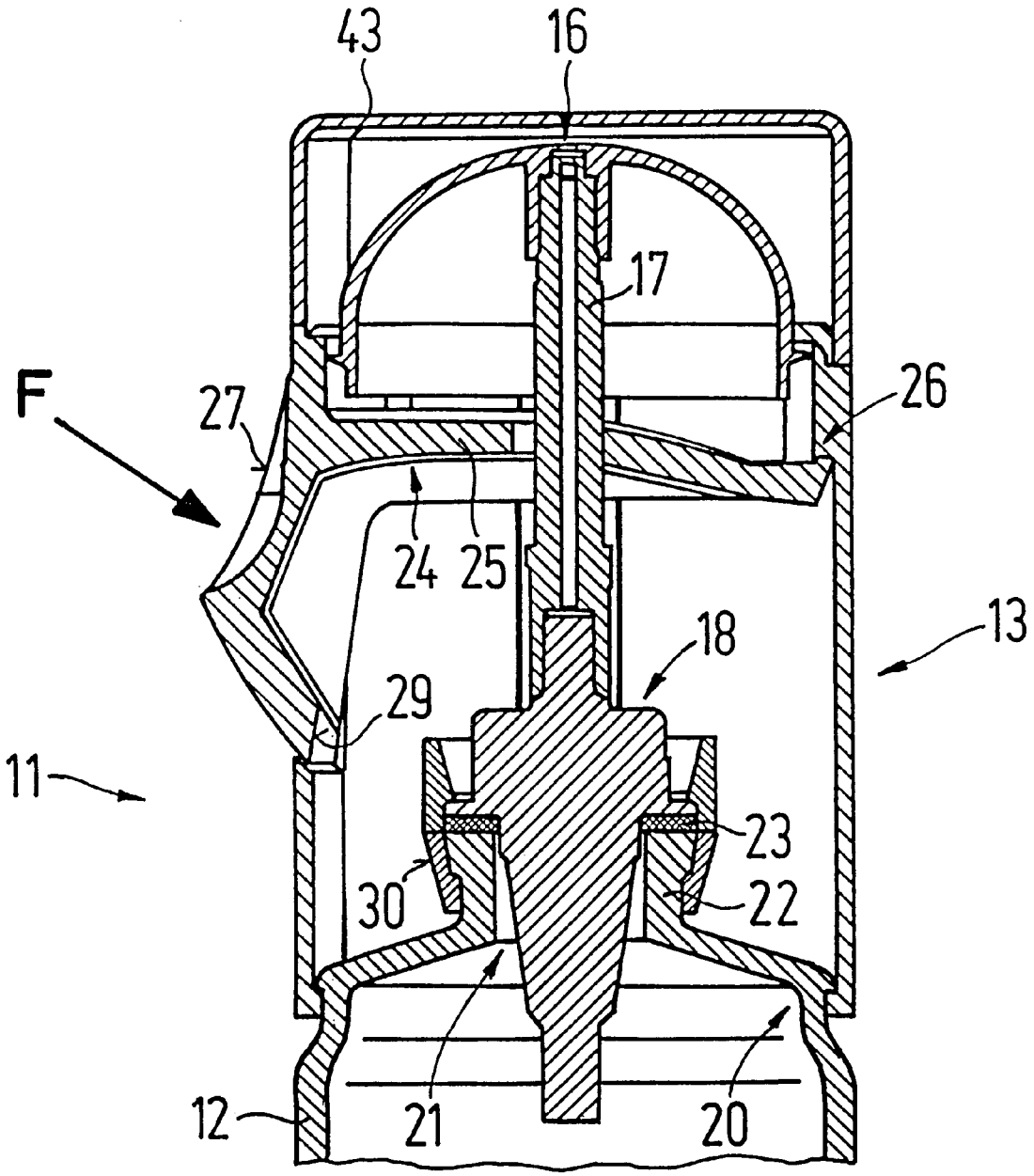

FIG. 2 A sectional representation through part of a discharge apparatus, in which on the actuating element is constructed a pivoted lever with a shaped operating element.

Figure 3A:
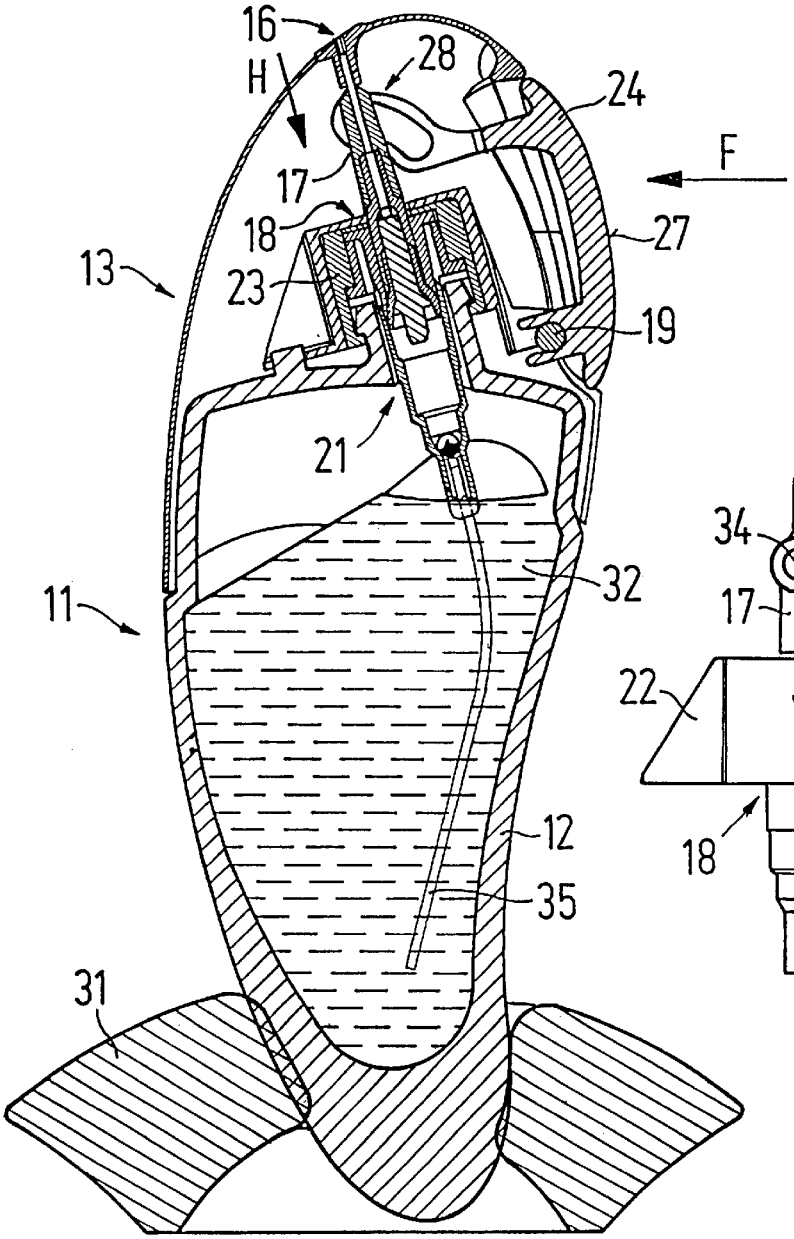
Figure 3B:
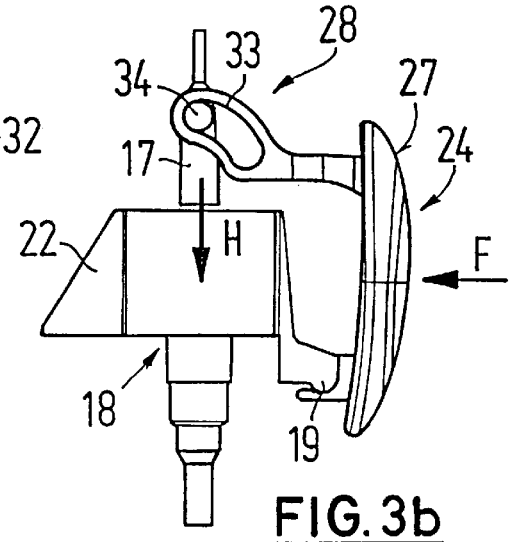
Figure 3C:
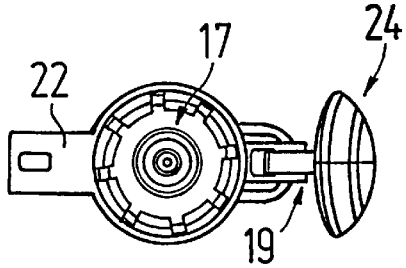

FIGS. 3*a* to 3*c* Sectional representations of a discharge apparatus, where the operating element is constructed as a guide link.

FIGS. 4*a* to 4*d* A discharge apparatus and parts thereof, where a container is kept fixed in a fixing point on the actuating element.

Figures 5A, 5B:
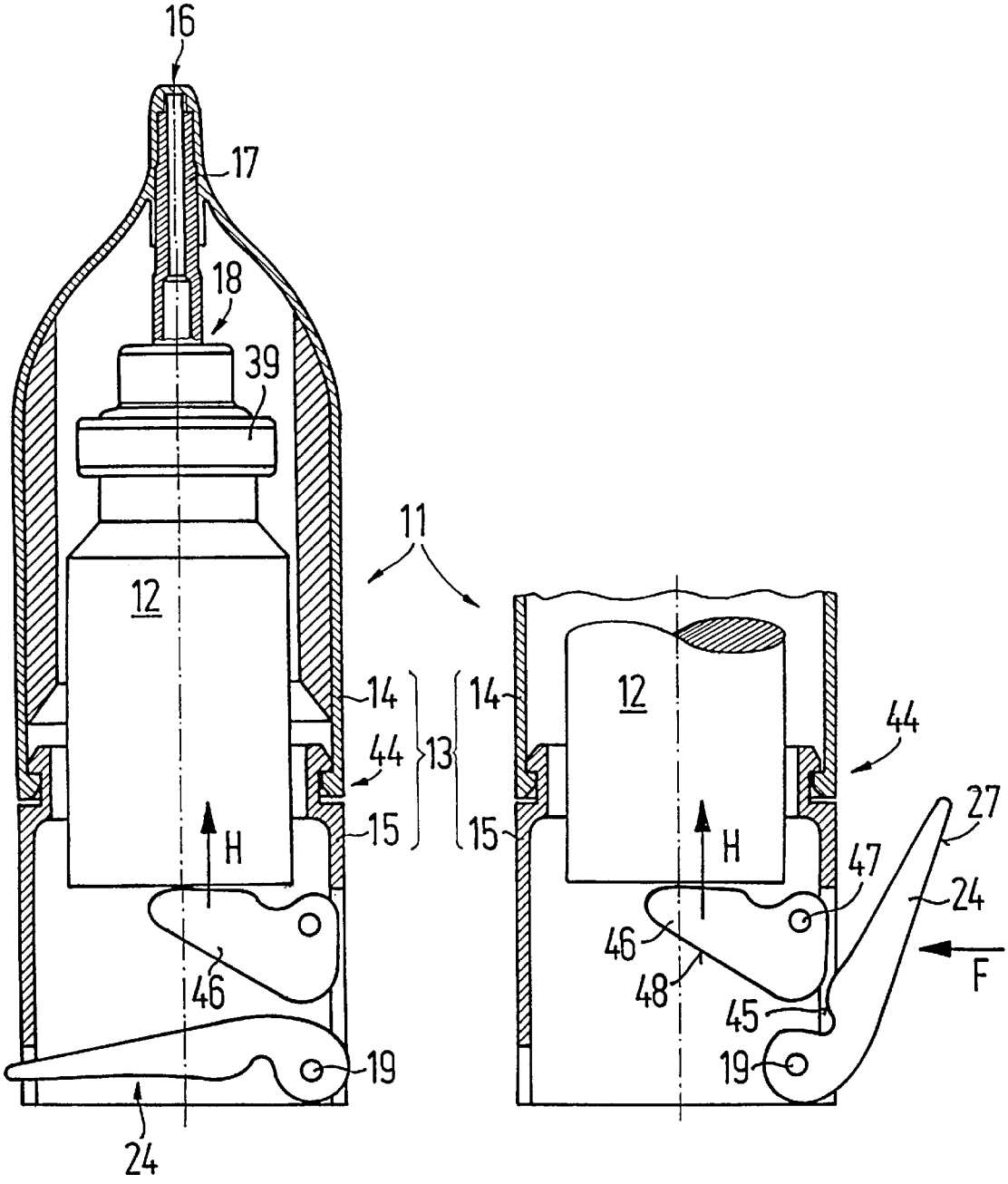

FIGS. 5*a* & 5*b* A discharge apparatus in which the actuating element acts by means of deflecting means on the media container.

Figure 6:
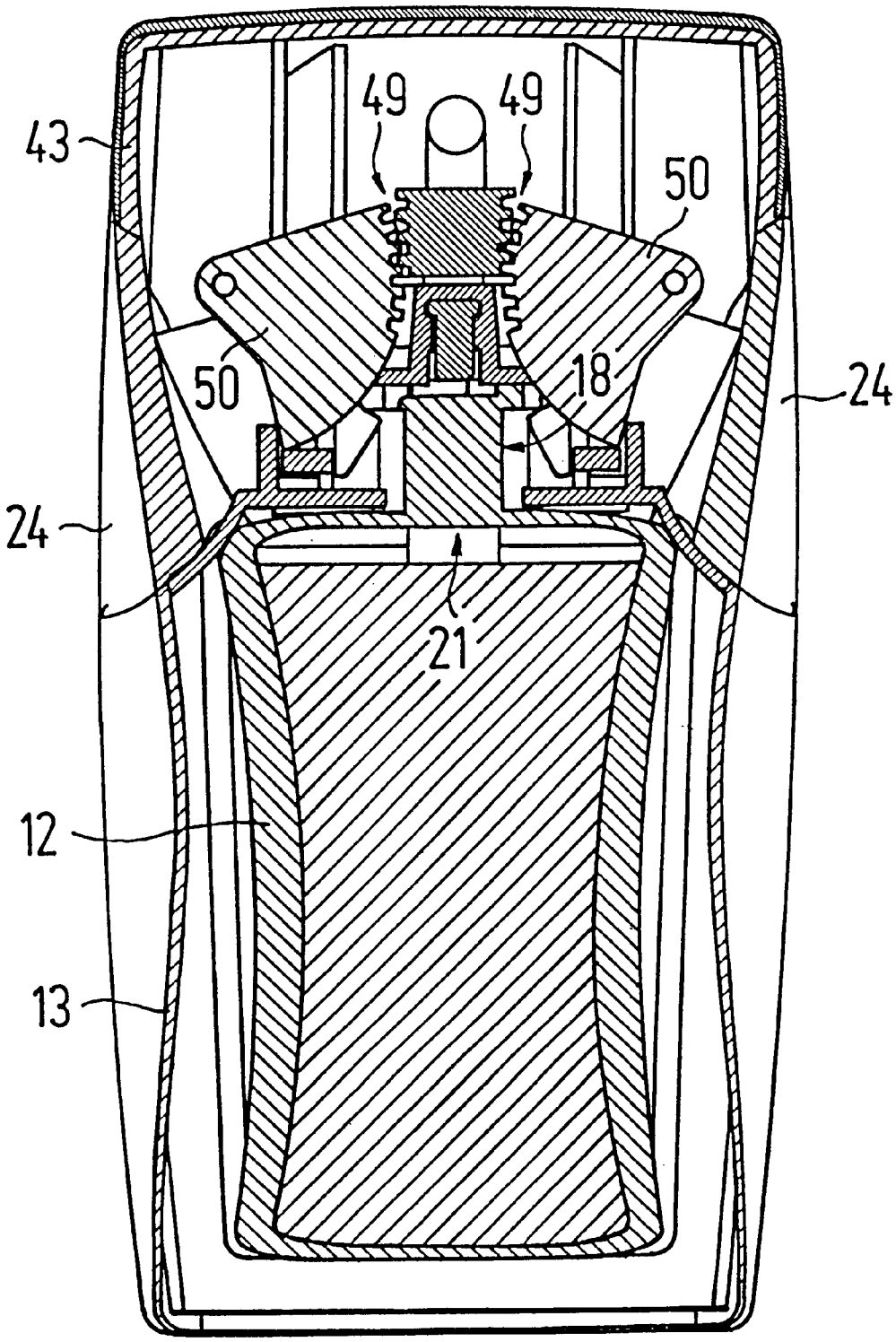

FIG. 6 A discharge apparatus in which the force producing a discharge stroke is transferred from the actuating element by means of a toothed gear to the pump element.

Figure 7B:
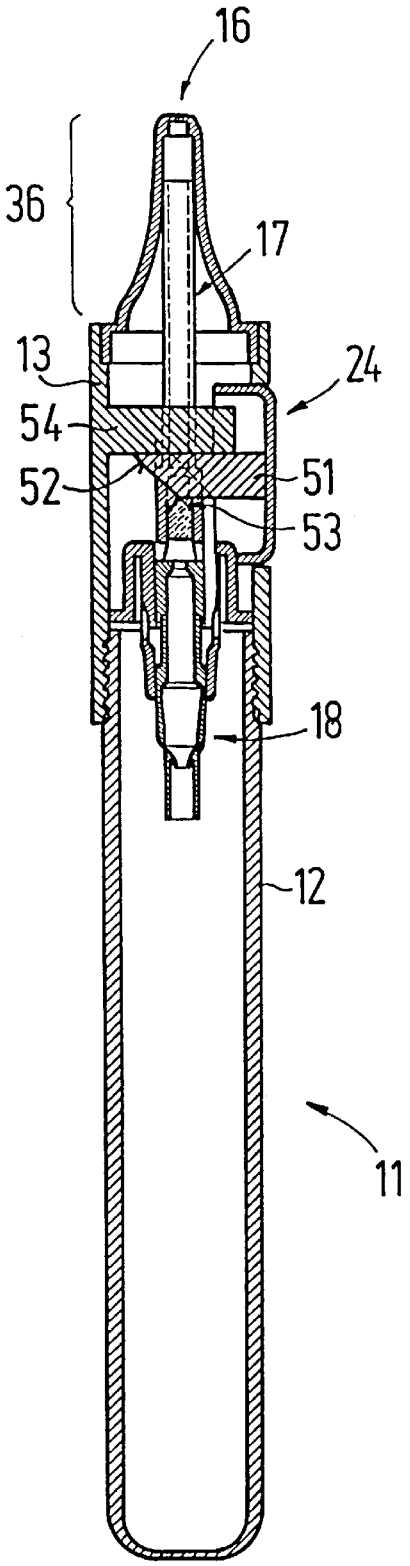
Figure 7A:
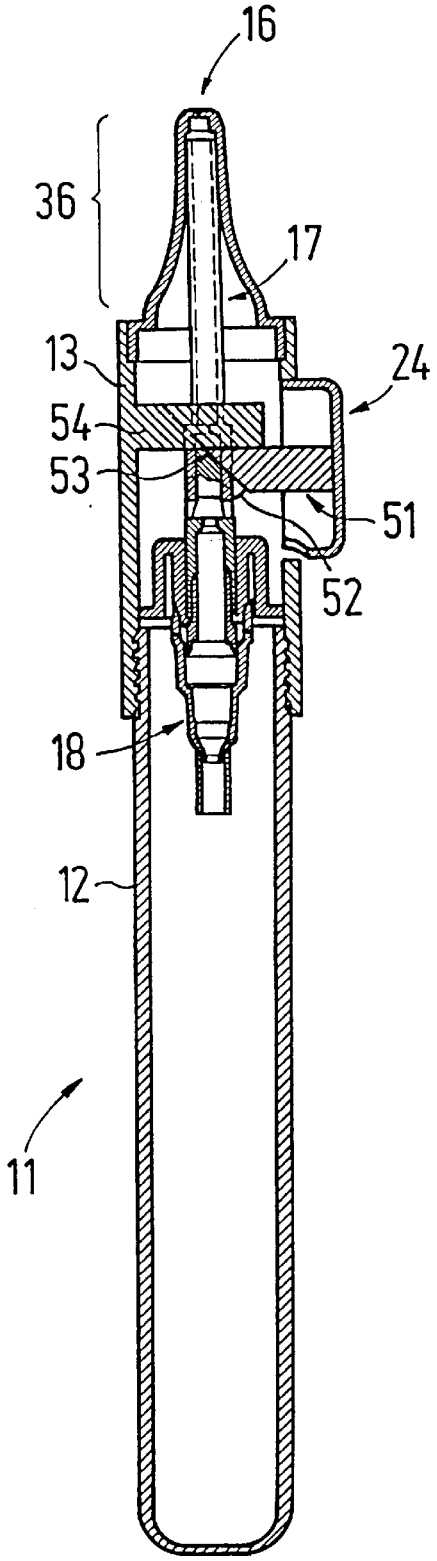

FIGS. 7*a* & 7*b* A discharge apparatus in which the actuating element is rectilinearly guided in a linear guide.

Figure 8A:
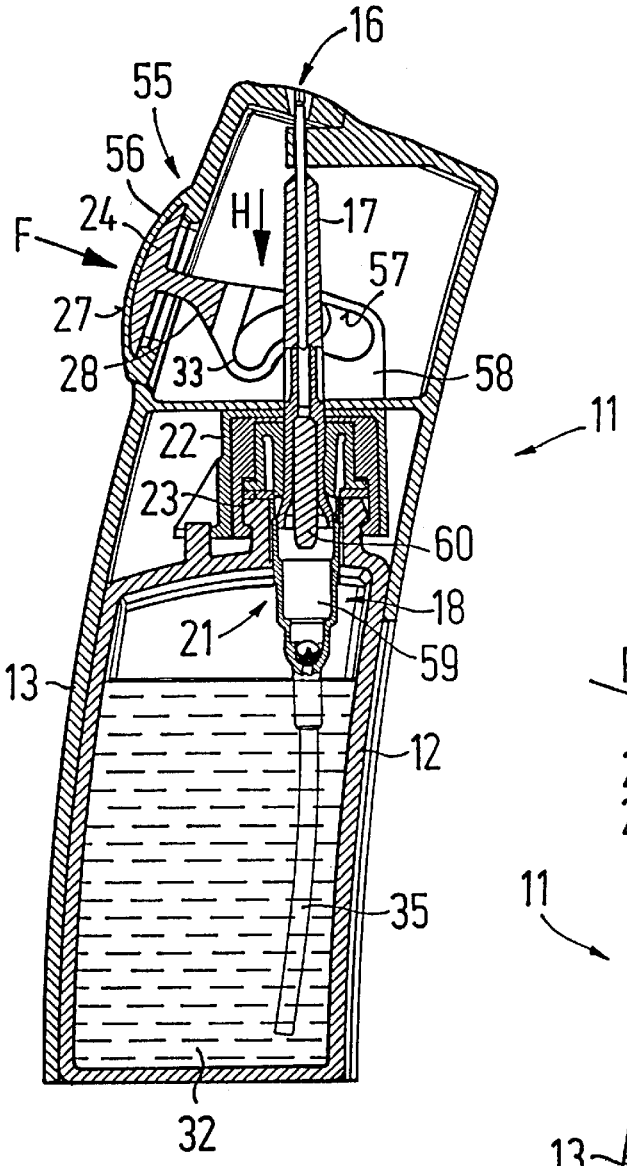
Figure 8B:
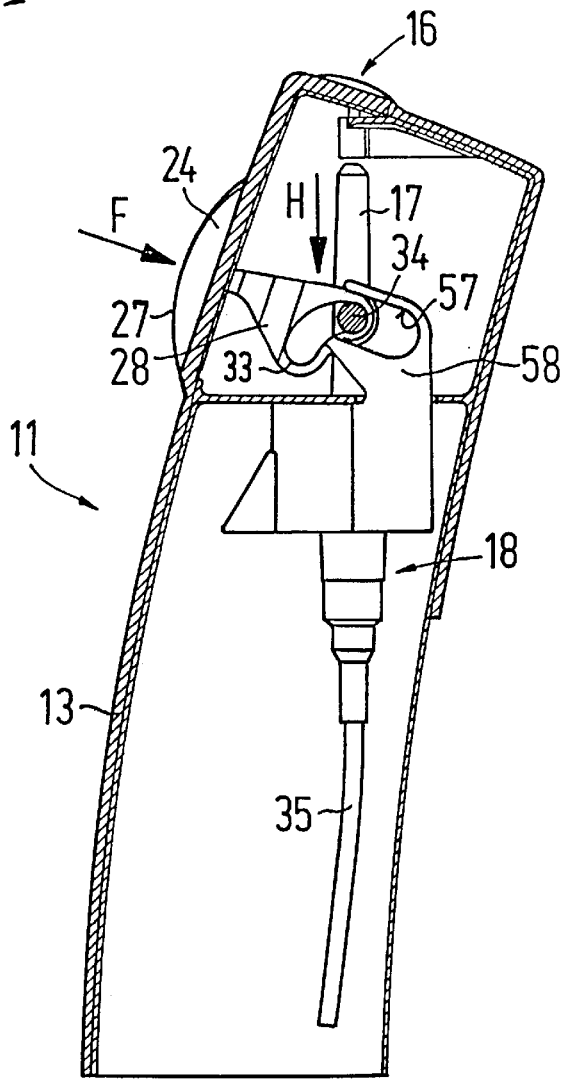

FIGS. 8*a* & 8*b* A discharge apparatus with a linear guide for the actuating element and a guide link for producing the discharge stroke.

FIGS. 1*a* and 1*b* show a discharge apparatus in a sectional representation, in which the discharge apparatus is actuated by bending part of the casing relative to the main part. FIG. 1*a* shows the unactuated starting position and FIG. 1*b* the actuated end position at the end of the production of a discharge stroke.

Such a discharge apparatus 11 has a medium or media container 12, which is fixed in or on the discharge apparatus casing 13. It is possible for the casing 13 to completely surround the media container 12 and consequently the latter is not visible to the outside. It is also possible, in the shown manner, for the casing to only partly form the discharge apparatus surface and in another area the media container 12 forms the outer surface of the discharge apparatus 11. The casing 13 is subdivided into two parts, namely the main body 14 and the part 15. The discharge opening 16 of the discharge apparatus is formed in part 15.

A rising tube 17 leads from the discharge opening 16 to the pump element 18. The pump element 18 shown is a piston pump. In the case of said piston pump a discharge is produced in that the volume of the pump chamber is reduced and this is brought about in that the casing part 15 is pivoted about the pivot pin 19 with respect to the main body 14 of the casing 13. The pivot pin 19 is at right angles to the movement line of the piston in the pump element 18. Thus, the part 15 of casing 13 is pivotable in a direction at right angles to the actuating direction of the pump element 18. On pivoting part 15 about the pivot pin 19 the rising tube 17 which for this purpose is not completely stiff is bent slightly in the vicinity of the pivot pin 19. The actuation of the pump element 18, here the displacement of the pump piston in the casing towards the container 12, is brought about in that during the pivoting movement a driver or dog acts on the reversing means 20. Through the reversing means 20 a force is produced in the actuating direction of the pump element 18 for producing a discharge stroke and consequently the pump element 18 is actuated. A complete stroke of the pump element 18 is produced if the part 15 is pivoted by a predetermined angle alpha relative to the main body 14. The angle alpha is in a range between 5 and 30ø, the angle shown here being 15ø. As a result of the discharge stroke the medium is delivered from the pump element via the rising tube to the discharge opening 16, where it is discharged.

If either by suitable restoring means, e.g. restoring springs, the part 15 is automatically or by manual actuation returned to its starting position shown in FIG. 1*a*, medium is sucked out of the media container 12 into the pump element 18. The sucked in medium is now available for the next discharge stroke. The suction line generally provided for this purpose and at least approximately leading to the lowest point of the media container is not shown in the drawing.

The media container 12 can in particular be a glass container and generally has an opening through which it is filled with medium. This opening is usually closed by the pump element 18, so that there is no need for a further glass container closure. As a result it is also unnecessary to provide a special passage point for the suction connection of a pump element or a separate pump element fitting point.

FIG. 2 shows an alternative discharge apparatus in part sectional form, in which the area of the media container 12 of said discharge apparatus 11 is not completely shown.

The media container 12 forms part of the surface of the discharge apparatus 11. At its upper end and prior to its tapering to the filling opening, the media container 12 has a circumferential groove 20 in which the casing 13 is locked.

The filling opening 21 of the media container, which is preferably a glass container, is constructed in the form of a connection having on its outside e.g. a thread or a notch system by means of which a fixing means 22, here a corresponding sleeve, can be fixed to the filling opening. Through the fixing means 22 the pump element 18, e.g. once again a piston pump, which is located in the casing 13 is so fixed to the media container 12 that the seal provided and the pump element close the filling opening 21. Into the casing interior the rising tube 17 extends from the pump element to the discharge opening 16. This rising tube 17 is shape-stable. It predetermines a fixed distance between the discharge opening 16 formed on the casing 13 and the movable parts of the pump element 18 used for producing a discharge stroke, i.e. particularly the piston.

The portion of the casing 13 having the discharge opening 16 is closed by a cover, e.g. for esthetic or hygienic reasons and said cover can be snapped onto the casing 13. The cover covers the discharge opening and is removed prior to use of the discharge apparatus.

The actuating element 24 is used for actuating the media container. The actuating element 24 is pivotably held in the casing-side abutment 26 by means of the pivot arm 25. Towards the outside the actuating element 24 has an ergonomically shaped handling surface 27. From the handling surface 27 an operating element 28 is directed inwards towards the fixing means 22. The actuating element 24, comprising pivot arm 25, handling surface 27 and operating element 28, forms a pivoted lever. If said pivoted lever is actuated by force introduction towards the force direction of the force vector F indicated by the arrow by the user, the actuating element 24 is pivoted round the abutment 26. During the pivoting movement a front, correspondingly chamfered engagement edge 29 engages with the contact surface 30 of the fixing means 22. If the actuating. movement is now continued, as a result of the chamfers of the surfaces a force is exerted on the media container 12, which moves the latter together with the pump element fixed therein upwards towards the discharge opening 16. For producing this media container movement towards the discharge opening 16, it is vital for the operating element 28 to engage with its engagement edge 29 on the fixing means 22. The media container 12 could also be differently designed in such a way as to have a bead, behind which engages the operating element and during the back-engagement produces the corresponding stroke movement of the media container 12. In this sense the fixing means 22 is to be looked upon as a bead of the media container 12. In principle it is merely necessary for an axial thrust to be produced between the operating element 28 and the media container which acts towards the orientation of the rising tube 17.

Thus, the actuating direction of the actuating element 24 differs from the stroke direction of the pump element 18. The discharge stroke is produced in that as a result of the thrust introduced on the media container 12 by the actuating element 24 said container is forced upwards towards the discharge opening 16. As the rising tube 17 has a shape-stable construction, the spacing between the movable parts of the pump element 18 on which the rising tube 17 is supported and the discharge opening 16 cannot be reduced. The corresponding supporting force is introduced on the movable parts of the pump element 18 and produced by a media discharge, particularly through the plunging of a plunger piston in a pump chamber. As soon as the actuating element 24 is released, i.e. as soon as the actuating force no longer acts on it, through the restoring spring which is e.g. located in the pump element 18 the media container 12 is returned to its starting position. The weight can have a supporting effect. For example, through a restoring spring the actuating element 24 is slid back into its starting position in the manner shown.

Furthermore, an elastic moulding component may be interposed between the actuating element 24 and the casing 13. Such an elastic moulding component ensures that the interior of the casing 13 will be completely encased on all sides. The tight sealing by the moulded component, not shown in FIG. 2, prevents contamination and damaging of the inside of the casing.

FIGS. 3*a* to 3*c* show a further embodiment of the invention.

The discharge apparatus 11 is shown in FIG. 3*a*, whereas FIGS. 3*b* and 3*c* show in side view and in a view from above in each case the pump element 18 and actuating element 24 with its operating element 28.

The discharge apparatus 11 is formed by a media container 12, which in part forms the outer surface of the discharge device 11 and the casing 13, which is connected flush to the media container 12. So that the discharge apparatus 11 can be set down on a flat surface, a receptacle 31 is provided in which the discharge apparatus 11 can be received and from which it can also be removed. The receptacle 31 can e.g. be constructed similar to a spherical segment with a depression for receiving the discharge apparatus 11.

The media container 12 has a cavity into which medium 32 can be filled. As also applies to other constructions shown in the drawings, the medium can be a liquid, in the manner shown here. The liquid can serve a pharmaceutical or cosmetic function, or both functions simultaneously. The medium can in particular contain pharmaceutical agents. However, it is also possible that the medium is only a liquid having cosmetic applications, e.g. a perfume or eau de toilette.

The casing 13 with the discharge opening 16 surrounds the area of the media container 12 having the filling opening 21 thereof, the latter being closed by the pump element 18. The pump element 18 is located in a fixing means 22, which also has a seal 23 for hermetically sealing the filling opening 21, in which the pump element is held. The fixing means 22 is e.g. secured by locking means on the media container 12. A rising tube 17 leads from the pump element 18 to the discharge opening 16 on the casing 13. On the casing 13 or alternatively on the media container 12 is mounted so as to pivot about the pivot pin 19 the actuating element 22. The actuating element is constructed like a toggle switch. On actuating the toggle switch with an actuating force corresponding to the arrow F by means of the operating element 28 an actuating force in the sense of producing a discharge stroke is produced. This discharge stroke is produced by a force directed in the direction of the force arrow H. The force for the discharge stroke is in the orientation of the axis of the pump element 18 and in the axis of the rising tube 17.

FIG. 3*b* shows that the operating element 28 is a guide link 33 in which is guided the slider 34. The slider 34 is either directly shaped on the pump element 18 or is constructed on the rising tube 17, which can indirectly act on the pump element 18 and its movable parts. By pivoting the actuating element 24 about the pivot pin 19 the slider is so guided in the guideway that a force is produced in direction H. The further force components acting on the slider 34 must be intercepted by the construction of the pump element 18. The discharge stroke can in particular be produced in that the slider is connected to the piston of the piston pump and moves the latter downwards towards the pump chamber, so that the volume thereof is reduced and consequently a discharge takes place. The medium 34 passes through the rising tube 17 to the discharge opening 16.

To ensure that medium is sucked into the pump chamber of the pump element 18, a suction line 35 leads from the pump element 18 to the bottom of the media container 12. This ensures that all the medium 32 stored in the media container 12 can be discharged through the pump element 18. As well with such a discharge device it is optional to form the actuating element as an integral piece, for example by using corresponding multicomponent injection moulding procedures. A resilient moulded component may cover the actuating element 24 or be in positive contact therewith. Another option is to produce the entire structural unit of casing 13, moulded component and actuating element 24 in common by injection moulding and to have them interconnected.

Figure 4C:
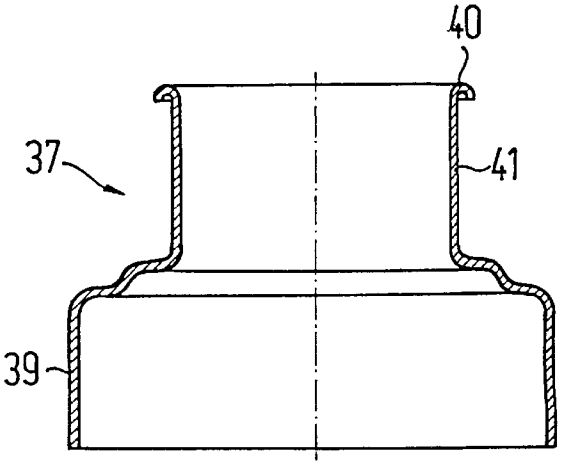
Figure 4B:
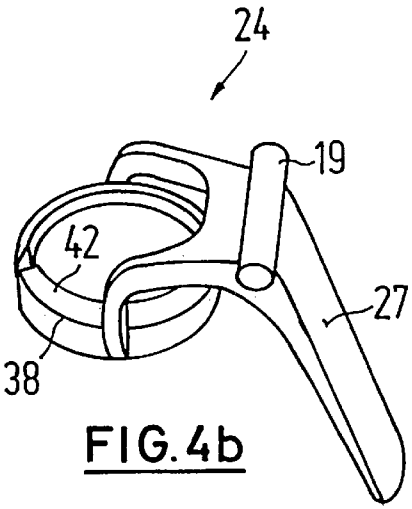
Figure 4A:
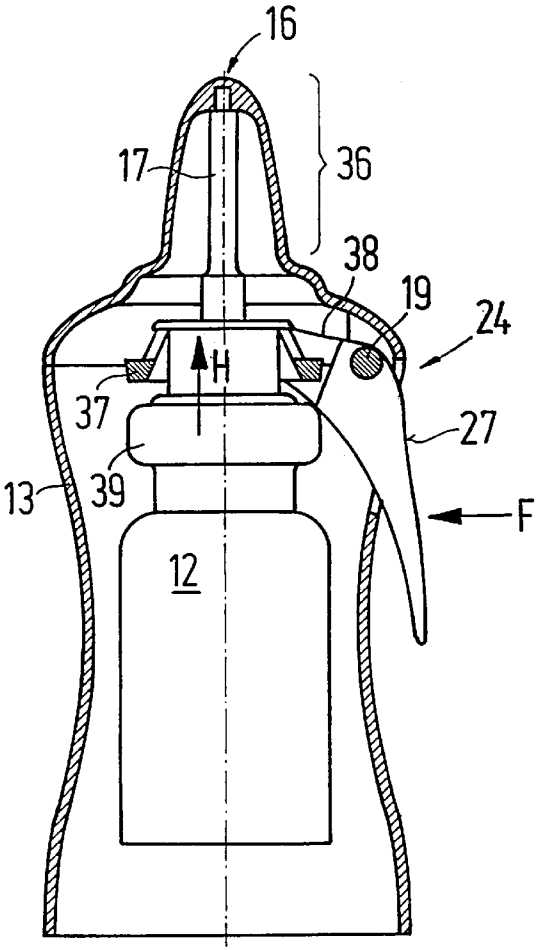

Each of the FIGS. 4*a* to 4*d* is a diagrammatic representation of an alternative embodiment of the invention. FIG. 4*a* is a sectional representation through the discharge apparatus, FIGS. 4*b* and 4*c* show the actuating element and holding means and FIG. 4*d* in a diagrammatic, part sectional representation illustrates an embodiment of the discharge apparatus with an actuation protection.

FIG. 4*a* shows in a part sectional representation the discharge apparatus 11. In the case of said discharge apparatus a casing 13 is provided, which forms the outer surface of the discharge apparatus. The media container 12 with the medium contained therein is located within the casing 13. A discharge opening 16 is formed on the casing 13, being located in an application area on said casing 13. The application area 36 serves to facilitate the application of the medium to the desired application location. This is e.g. the case if the medium is to be applied in intranasal manner, such as can be the case with media containing pharmaceutical agents. Media to be applied in intranasal manner, are e.g. anti-migraine agents, anti-headache agents and other analgesics, which can rapidly and effectively pass via the nasal mucosa into the blood stream and for which the nose area is consequently a preferred introduction location.

From the discharge opening 16 the rising tube 17 leads to the pump element 18, which is not shown in this drawing. The actuating element 24 actuates the discharge apparatus 11 and is arranged in the casing 13 so as to pivot about the pivot pin 19. The actuating element 24 comprises a handling surface 27 and a retaining ring 38.

The medium container 12, preferably a glass container, has a filling opening, which is closed by means of the pump element 18. In order to fix the pump element in sealed manner to the filling opening, said pump element is permanently fixed in tight manner for the medium by means of a crimp sleeve 39, optionally using a plug or other sealing means. The media container 12 is fixed in the casing 13 in that it is held in the retaining ring 38 of the actuating element 24.

For actuating the discharge apparatus 11 the user must introduce a force acting in the direction of the arrow F by means of the handling surface 27 onto the actuating element 24. By pivoting the actuating element 24 about its pivot pin 19, with the aid of a force acting in the direction of arrow H, the media container 12 is urged by means of the holding or retaining means 37 towards the discharge opening. As the rising tube 17 is shape-stable and is supported on parts of the pump element 18 movable relative to the media container 12 counter to the force direction H, there is a movement of the media container relative to the rising tube 17. A discharge stroke is produced by the displacement of the movable parts of the pump element 18.

FIG. 4*b* shows the actuating element 24. With respect to the pivot pin 19 of the actuating element 24, which is held on the casing side in corresponding abutments, the handling surface 27 forms a lever or moment arm for producing a pivoting movement, i.e. an actuation of the actuating element. The retaining ring 38 projects from the pivot pin 19 at an angle to the handling surface 27. The retaining ring can be an open ring into which are inserted the retaining means 37, shown in FIG. 4*c* and which can be securely held in the retaining ring 38. For this purpose the ring segments 38*a* and 38*b* are spread apart and after inserting the retaining means 37 they are embraced in an angular range greater than 180ø by the ring segments 38*a* and 38*b*. To ensure a reliable engagement behind of the flanged ring 40 of the retaining means 37, a corresponding tapered, chamfered, back-engaging sloping surface is formed on the retaining ring.

FIG. 4*c* shows the holding or retaining means 37 constituted by a modified crimp sleeve 39. The crimp sleeve 39 fixes in the conventional manner the pump element 18 and optionally additional sealing means such as a rubber plug in the filling opening 21 of the media container 12. The free ends of the crimp sleeve are for this purpose bent around a correspondingly constructed not shown bead in the vicinity of the opening 21 of the media container 12 in such a way that there is a firmly engaging fixing for the pump element 18 and in certain circumstances the sealing means. As a result of this type of fixing a media-tight fixing of the pump element 18 in the filling opening can be obtained. Over and beyond the conventional design of a crimp ring, the retaining means 37 has a standing collar 41 on which projects the crimp sleeve side remote from the media container 12. The standing collar 41 is bounded by the flanged ring 40. Alternatively to the flanged ring there could also be some other diameter enlargement, such as a bead. The sloping surface 42 of the retaining ring 38 can readily engage behind the flanged ring 40. Thus, a force transfer in the axial direction, i.e. in the orientation of the standing collar 41 is readily possible.

Figure 4D:
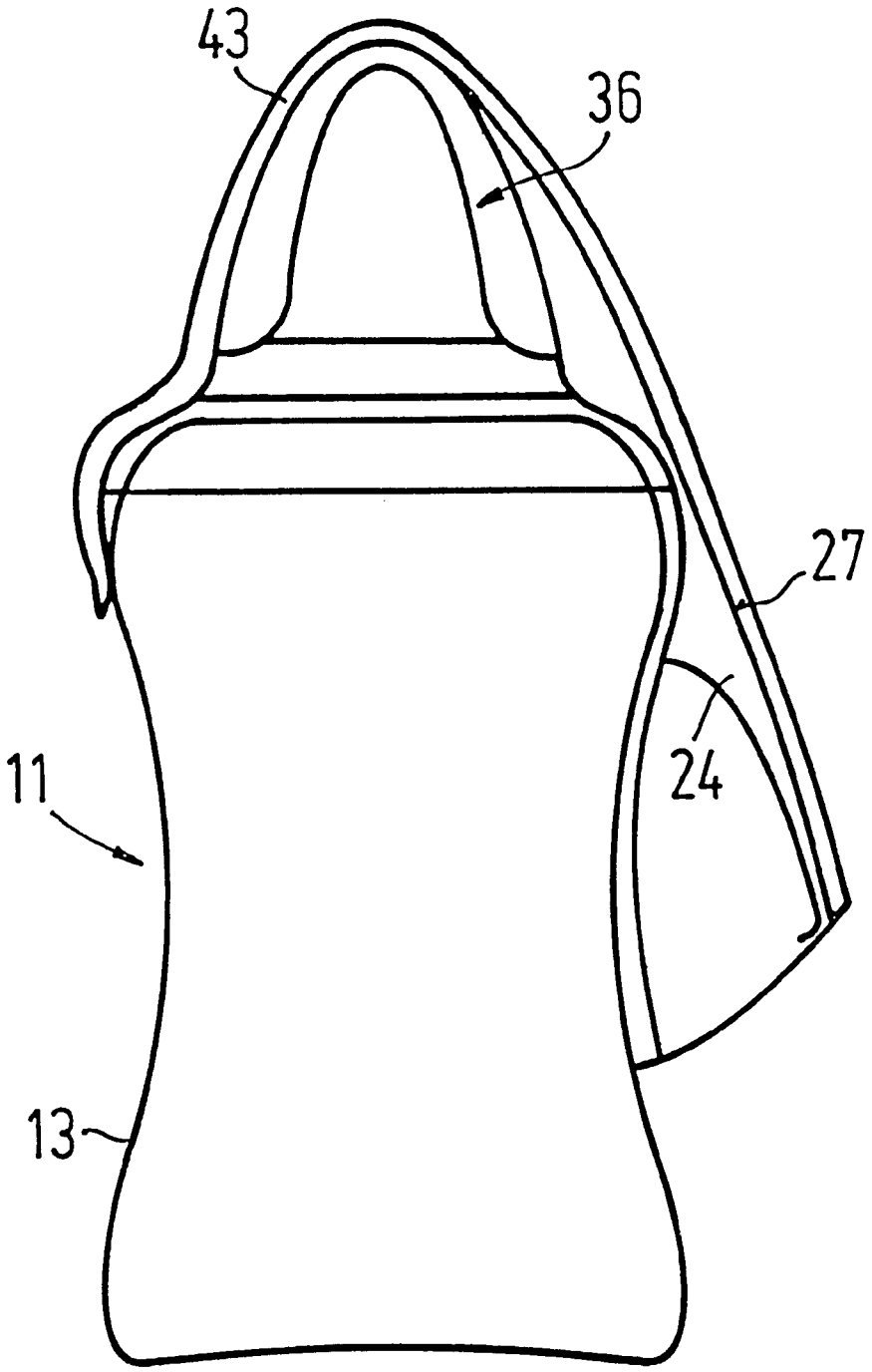

FIG. 4*d* shows in side view the discharge apparatus 11 of FIG. 4*a*. The casing 13 of the discharge apparatus 11 is covered in the vicinity of the actuating element 24 and the application area 36 by the cover 43, which is secured on the casing 13 by a locking connection. Due to the fact that the cover 43 also covers the actuating element 24 with its handling surface 27, there is an effective protection against unintended actuation of the discharge apparatus 11.

FIGS. 5*a* and 5*b* show another embodiment of the invention. FIG. 5*a* shows the starting position secured prior to actuation, whereas FIG. 5*b* shows the actuation-ready position of the actuating element.

The discharge apparatus 11 has a casing 13, which is subdivided into a main body 14 and a part 15. The subdivision of the casing is in two parts so as to permit easy replacement of the media container 12. Part 15 is connected to the main body 14 by a locking connection 44. In this embodiment the media container 12 is completely concealed in the casing 13. The main body of the casing has the discharge opening 16 from which a shape-stable rising tube 17 leads to the pump element 18, which is fixed in fluid-tight manner and by means of the crimp sleeve 39 to the filling opening 20 of the media container 12.

The media container 12 is held in guided manner in the main body 14 of the casing 13 and is axially displaceable towards the discharge opening 16. during displacement action indirectly takes place by means of the rising tube 17 on the movable parts of the pump element 18, so that a discharge stroke is produced. The actuating element 24, which is arranged pivotably about the pivot pin 19, is used for actuating the discharge apparatus 11. In FIG. 5*a* the actuating element 24 is held in position, e.g. by locking, where a direct actuation of the discharge apparatus is impossible. It is consequently a storage or transportation position, where it is ensured that there can be unintentional actuation of the discharge apparatus. By pivoting the actuating element 24 into the position shown in FIG. 5*b*, the actuation readiness of the discharge apparatus 11 is made clear. The actuating element 24 has a handling surface 27 in which the user introduces the actuating force. The spacing between the force introduction location and the pivot pin 19 gives a leverage. At the side of the actuating element 24 remote from the handling surface 27 is formed a contour line 45, which predetermines the bearing of the actuating element on the reversing means 46. Due to the curvature of the contour line 45 there is a modification of the variable spacing of the bearing point of the actuating element 24 on the reversing means 46 with respect to the pivot pin 19 of the actuating element and the spacing of said bearing point from the pivot pin 47 of the reversing means 46, so that the leverage can be varied. For this purpose there is a corresponding shaping of the contour line 48 of the reversing means 46. Through modifying the leverage it is possible to produce a different, actuation path-dependent variable transmission ratio between the actuating force of the actuating element and the force acting on the media container.

In the embodiment shown the reversing means 46 is constructed as a lever (cam) pivotable about the pivot pin 47. Apart from the production of a suitable transmission ratio between the actuating element 24 and media container 12, the reversing means 46 more particularly serves to reverse the force direction in such a way that the main force component is introduced in the direction of the force vector H, i.e. in the direction of the discharge opening 16 in the media container 12. As a result of the force the container 12, on actuation, is displaced towards the discharge opening with a transverse force component-free force introduction. However, it is also possible to axially guide the media container in the casing 13. In addition, the reversing means 46 ensures that the media container 12 cannot slide or drop out of the casing. This is necessary because the media container 12 is not permanently fixed in the casing 13 and is instead movable relative thereto, so that a discharge stroke of the pump element is possible through an axial displacement towards the direction vector H of the media container 12.

FIG. 6 shows a discharge apparatus, which discharges medium by actuating actuating elements 24. The media container 12 is located in the casing 13 closed by the cover 43 and whose filling opening 21 is closed by the pump element 18. The pump element is actuated by means of the actuating elements 24 for producing a discharge stroke. Each of these actuating elements acts on a toothed washer 50, which has a toothed segment over at least part of its outer radius. Both the actuating element 24 and the toothed washer 50 are arranged pivotably about an axis. The casing 13 contains two actuating elements with each of which is associated a toothed washer 50. The two actuating elements are arranged symmetrically to one another with respect to the median axis of the discharge apparatus.

A coupling between the two toothed washers and therefore a coupling between both actuating elements is brought about in that they engage on a movable pump element, which can bring about a media discharge through an axial stroke and which is constructed facing both toothed washers in the form of a rack 49. This embodiment makes it possible for the complete media container to be fixed in the casing 13. Force transmission between the actuating means 24 and pump element takes place by means of the interengaging teeth of the rack 49 and toothed washers 50 and this also brings about the force direction reversal. The toothed washers 50 and rack 49 form a toothed gear.

The embodiments of FIGS. 7*a* and 7*b* and FIGS. 8*a* and 8*b*, unlike in the case of the preceding drawings, show discharge apparatuses 11, in which the actuating element 24 is axially guided and not pivotable.

FIGS. 7*a* and 7*b* show in the unactuated or actuated position a discharge apparatus 11 with an actuating element 24 on which a slide 51 is constructed for actuating the pump element 18. The slide 51 has a chamfered engagement edge 52, which acts on a correspondingly constructed flank 53 of the movable part of the pump element. During actuation of the actuating element 24 the engagement edge 52 and flank 53 slide on one another. Through the actuating element 24 being axially guided and this taking place in the transverse direction of the extension or stroke direction of the pump element 18, a direction reversal of the force action is produced via the two flanks. This makes it possible to produce a discharge stroke and consequently media discharge via the rising tube 17 to the discharge opening 16. At least one of the actuation means engagement edge 52 and flank 53 are chamfered to provide a reversal of the actuating force. The slopes of the flanks in relation to another define a translation and thus the interrelation between actuation path and required actuation force.

The actuating element 24 is located in the casing 13 of the discharge apparatus 11. In the represented embodiment the media container 12 once again forms part of the outer face of the discharge apparatus. The discharge opening 16 is located in an application area 36 of the casing 13. For producing the linear guidance of the slide 51 a supporting bar 54, which also ensures a corresponding support of the slide 51, so that the actuating force can be transformed without loss into a pump element actuation.

To ensure an optimum force transmission or transfer and the compensation of transverse force components, it is possible to provide on either side of the pump element and therefore on either side of the rising tube 17 in each case one slide 51, which then acts on in each case one flank 53 of the pump element 18. As well with such an embodiment an optional elastic moulded component provided between actuation element 24 and casing 13 ensures a hermetic joint and produces a plane closed contour to the exterior.

FIGS. 8*a* and 8*b* show a discharge apparatus 1, in which the actuating element 24 is linearly actuatable and pump element actuation takes place by means of a guide link. FIG. 8*a* is a sectional representation through the discharge apparatus 11 and FIG. 8*b* a guide of the guide link and its action on the pump element 18.

The discharge apparatus 11 has a media container 12, which is located in a casing 13 surrounding said container 12. In the vicinity of its filling opening 20 the container 12 is closed by the pump element 18. For this purpose the pump element 18 is inserted in the filling opening 21 and held therein by the fixing means 22. It is also possible to provide a seal 23 for the satisfactory sealing of the filling opening 21. The pump element 18 is a piston pump. The shape-stable rising tube 17 forming the connection between the pump element 18 and the discharge opening 16 in the casing 13, acts on the pump piston inserting the pump chamber of the pump element 18 and can transfer thereto the force necessary for producing a discharge stroke. The rising tube 17 is positioned coaxially to the piston pump extension. To ensure a complete suction of the medium 32 through the pump element 18 the suction line 35 is provided, which at least approximately leads to the bottom of the media container 12. Appropriately the casing 13 receives all the elements with the exception of the container 12 to be filled and can be prefabricated as a subassembly. The casing 13 is then mounted on the media container 12 and the connection between the pump element 18 and filling opening 21 serves as a fixture. The connection can e.g. be constructed in the manner of a notch or screw connection.

The actuation of the actuating element 24 essentially takes place in the direction of its surface normal corresponding to the force arrow F. For this purpose the actuating element is mounted in such a way that it is linearly movable in the casing. The actuating element 24 is constructed in the manner of a button, which is operated by depression. In order to ensure a good sealing of the passage opening 55 necessary for the actuating element 24, it is possible to provide a material layer 56, which forms an elastically deformable connection between the actuating element 24 and the casing 13. The handling surface 27 of the actuating element 24 can also be formed from this material layer, which can also serve to produce a pleasant gripping feel on actuating the actuating element 24.

The operating element 28 of the actuating element 24 is constructed as a guide link 33. A slider 34 constructed on the rising tube 17 is guided in the guide link 33. In order to permit a good linear guidance and a supporting of the forces in the casing 13, the support body 58 is provided, which has a guideway 57 in which is also guided the slider 34. The support body 58 can either be connected directly to the casing 13 or can be constructed or shaped on the fixing means 22, which are at least indirectly supported on the casing 13.

If the actuating element 24 is actuated towards the force vector F, then it is linearly displaced in rectilinear manner. Any material layer 56 must then deform elastically. The operating element 28 would also be linearly displaced. The linearity of the movement is at least partly produced by means of the support of the slider 34 in the guideway 57. The slider 34 guided in the guide link 33 is moved downwards in the direction of the pump element 18 in the direction given by the vector H as a result of the shape of the guide link 33, which is e.g. approximately circular segmental. The transverse force component also transferred to the operating element 28 and acting on the slider 34 is supported in the guideway 57. Thus, through an actuation of the actuating element 24 the volume of the pump chamber 59 of the pump element is reduced in that the piston 60 is moved downwards by the rising tube 17. Thus, a medium discharge is produced via the volume reduction of the pump chamber 59. The actuating element is released at the end of actuation. As a result of the restoring forces acting at least indirectly on the actuating element 24 and e.g. produced by a restoring spring, it is moved back into its starting position in the manner shown in FIGS. 8*a* and 8*b*. For this purpose restoring springs can be provided in the pump chamber 59 so as to prevent an actuation. It would alternatively be possible to provide such springs somewhere else on the pump element 18. During the restoring movement the volume of the pump chamber 59 is increased again and consequently medium is sucked in by means of the suction line 35.

What is claimed is:

1. Discharge apparatus for media, having a casing provided with a discharge opening for discharging the medium, a media container located in the casing for storing the medium, a pump including a pump element being moveable for delivering the medium from the media container to the discharge opening, an actuating element for performing at least one discharge stroke of the pump element in a stroke direction in response to an actuating force applied to the actuating element in an actuating direction, the stroke direction of the pump element and the actuating direction of the actuating element differing from one another, fixing means for fixing the pump on a neck of the media container including a collar projecting from the fixing means away from the media container, said collar being bounded above by a retaining element of enlarged diameter in relation to the collar, and the actuating element being a pivotable lever including a handle for applying the actuating force, a pivot element for pivotably supporting the actuating element on the casing and the retaining element being spreadable to receive the collar of the fixing means into the retaining element and to engage behind the retaining element of enlarged diameter, thereby embracing the collar and holding the media container moveable relative to the casing.

2. Discharge apparatus according to claim 1, wherein a rising tube leads from the media container to the discharge opening, the rising tube being constructed in shape-stable manner, said rising tube actuating the pump element upon the relative movement between the media container and the casing.

3. Discharge apparatus according to claim 1, wherein the fixing means is a crimp sleeve and the retaining element is a flanged ring.

4. Discharge apparatus according to claim 1, wherein the retaining element has a sloping surface.

5. Discharge apparatus according to claim 1, wherein a cover is provided for covering the handle of the actuating element and an application area around the discharge opening and for being secured to the casing by a lock connection.

6. Discharge apparatus according to claim 1, wherein an angle between the stroke direction of the pump element and the actuating direction is approximately ninety degrees.

* * * * *